US006973793B2

(12) United States Patent
Douglas et al.

(10) Patent No.: US 6,973,793 B2
(45) Date of Patent: Dec. 13, 2005

(54) ESTIMATING EVAPORATOR AIRFLOW IN VAPOR COMPRESSION CYCLE COOLING EQUIPMENT

(75) Inventors: Jonathan D. Douglas, Lawrenceville, NJ (US); Marcus V. A. Bianchi, Newton, PA (US); Todd M. Rossi, Princeton, NJ (US)

(73) Assignee: Field Diagnostic Services, Inc., Fairless Hills, PA (US)

( * ) Notice: Subject to any disclaimer, the term of this patent is extended or adjusted under 35 U.S.C. 154(b) by 226 days.

(21) Appl. No.: 10/614,598

(22) Filed: Jul. 7, 2003

(65) Prior Publication Data

US 2004/0144106 A1 Jul. 29, 2004

Related U.S. Application Data

(60) Provisional application No. 60/394,509, filed on Jul. 8, 2002.

(51) Int. Cl.[7] ..... F25B 49/00; F25D 17/00

(52) U.S. Cl. ..... 62/127; 62/178; 62/222; 702/183

(58) Field of Search ..... 62/177, 178, 127, 62/129, 222, 224; 165/4.1; 236/94; 702/182, 183

(56) References Cited

U.S. PATENT DOCUMENTS

| | | | | |
|---|---|---|---|---|
| 3,082,951 A | | 3/1963 | Kayan | 235/184 |
| 3,707,851 A | | 1/1973 | McAshan, Jr. | 62/125 |
| 3,738,765 A | | 8/1973 | O'Dell | 62/127 |
| 4,114,448 A | | 9/1978 | Merritt | 73/382 |
| 4,181,106 A | | 1/1980 | Brakebill | 62/115 |
| 4,186,563 A | | 2/1980 | Schulze, Sr. | 62/126 |
| 4,217,761 A | | 8/1980 | Cornaire et al. | 62/130 |
| 4,325,223 A | | 4/1982 | Cantley | 62/126 |
| 4,381,549 A | | 4/1983 | Stamp, Jr. et al. | 364/557 |
| 4,432,232 A | | 2/1984 | Brantley et al. | 73/432 |
| 4,510,576 A | | 4/1985 | MacArthur et al. | 364/551 |
| 4,611,470 A | | 9/1986 | Enstrom | 62/127 |
| 4,724,678 A | * | 2/1988 | Pohl | 62/80 |
| 4,755,957 A | | 7/1988 | White et al. | 365/551 |
| 4,768,346 A | | 9/1988 | Mathur | 62/127 |
| 4,798,055 A | | 1/1989 | Murray et al. | 62/127 |
| 4,885,914 A | | 12/1989 | Pearman | 62/129 |
| 4,928,278 A | | 5/1990 | Otsuji et al. | 714/700 |
| 4,967,567 A | | 11/1990 | Proctor et al. | 62/127 |
| 5,003,256 A | | 3/1991 | Merrill | 714/814 |
| 5,010,743 A | | 4/1991 | Hale | 62/292 |
| 5,026,171 A | * | 6/1991 | Feller | 374/41 |
| 5,083,438 A | | 1/1992 | McMullin | 62/129 |
| 5,115,643 A | | 5/1992 | Hayata et al. | 62/115 |
| 5,209,076 A | | 5/1993 | Kauffman et al. | 62/126 |
| 5,231,598 A | | 7/1993 | Vlahos | 714/700 |
| 5,239,865 A | | 8/1993 | Salzer et al. | 73/292 |
| 5,596,507 A | | 1/1997 | Jones et al. | 364/505 |
| 5,623,834 A | | 4/1997 | Bahel et al. | 62/131 |
| 5,666,815 A | | 9/1997 | Aloise | 62/129 |

(Continued)

OTHER PUBLICATIONS

Air Conditioning and Refrigeration Institute (ARI) Standard 540–1999, Positive Displacement Refrigerant Compressors and Compressor Units, Air Conditioning and Refrigeration Institute, 1999, 38 pages.*

A. E. Dabiri and C. K. Ric, 1981. "A Compressor Simulation Model with Corrections for the Level of Suction Gas Superheat," ASHRAE Transactions, vol. 87, Part 2, pp. 771–782.

(Continued)

*Primary Examiner*—Marc Norman

(74) *Attorney, Agent, or Firm*—Mark A. Garzia, P.C.; Mark A. Garzia

(57) ABSTRACT

A method for determining airflow through an evaporator coil in a vapor compression cycle by measuring the moist air conditions entering and leaving the coil, and various temperatures and pressures in the refrigerant of the vapor compression cycle. The mass airflow rate and the volumetric airflow rate are then determined.

14 Claims, 2 Drawing Sheets

U.S. PATENT DOCUMENTS

| | | | | | |
|---|---|---|---|---|---|
| 5,746,061 | A | * | 5/1998 | Kramer | 62/127 |
| 5,760,478 | A | | 6/1998 | Bozso et al. | 257/777 |
| 5,934,088 | A | | 8/1999 | Takeda | 62/127 |
| 5,991,890 | A | | 11/1999 | Brown et al. | 713/503 |
| 6,128,910 | A | * | 10/2000 | Faircloth | 62/129 |
| 6,223,544 | B1 | | 5/2001 | Seem | 62/127 |
| 6,272,868 | B1 | | 8/2001 | Grabon et al. | 62/125 |
| 6,324,854 | B1 | | 12/2001 | Jayanth | 62/127 |
| 6,360,551 | B1 | | 3/2002 | Renders | 62/127 |
| 6,439,061 | B1 | | 8/2002 | Nelson et al. | 73/861.65 |
| 6,560,976 | B2 | | 5/2003 | Jayanth | 62/127 |
| 6,601,397 | B2 | | 8/2003 | Pham et al. | 62/181 |
| 6,615,574 | B1 | | 9/2003 | Jayanth | 62/126 |
| 6,658,373 | B2 | * | 12/2003 | Rossi et al. | 702/185 |
| 6,701,725 | B2 | * | 3/2004 | Rossi et al. | 62/125 |
| 2002/0170299 | A1 | | 11/2002 | Jayanath et al | 62/126 |
| 2003/0051490 | A1 | | 3/2003 | Jayanath | 62/127 |
| 2003/0115890 | A1 | | 9/2003 | Jayanth | 62/126 |

OTHER PUBLICATIONS

Copy from website for iSH North America entitled "Restricted Airflow: A Common Culprit"by John Tomczyk; www. achmews.com/CDA/ArticleInformation...

Copy from website for Contracting Business Interactive entitled "Beware of Filter Pressure Drop" by Kevin O'Neil; www.contractingbusiness.com/editorial serviceonline/...

Copy of article entitled, "Effect of reduced evaporator airflow on the high temperature performance of air conditioners" by Angel G. Rodriguez et al., Elsevier Science S.A., Energy and Buildings 24 (1996) 195–201.

Copy from website for iSH North America entitled "Performing Residential A/C Airflow Setup" by Scott Neimark; www..achmews.com/CDA/Articleinformation...

* cited by examiner

ESTIMATING EVAPORATOR AIRFLOW IN VAPOR COMPRESSION CYCLE COOLING EQUIPMENT

CROSS REFERENCE TO RELATED APPLICATIONS

The present application claims the benefits under 35 U.S.C. §119(e) of U.S. Provisional Application No. 60/394,509 filed Jul. 8, 2002, titled ESTIMATING EVAPORATOR AIRFLOW IN VAPOR COMPRESSION CYCLE EQUIPMENT in the name of Todd M. Rossi, Jonathan D. Douglas and Marcus V. A. Bianchi.

U.S. Provisional Application No. 60/394,509, filed Jul. 8, 2002, is hereby incorporated by reference as if fully set forth herein.

FIELD OF THE INVENTION

The present invention generally relates to the science of psychrometry and to heating, ventilating, air conditioning, and refrigeration (HVAC&R). More specifically, the invention relates to the use of psychrometric measurements, refrigerant temperature and pressure measurements in association with compressor performance equations to calculate the airflow rate through an evaporator in cooling equipment running a vapor compression cycle.

BACKGROUND OF THE INVENTION

The most common technology used in HVAC&R systems is the vapor compression cycle (often referred to as the refrigeration cycle). Four major components (compressor, condenser, expansion device, and evaporator) connected together via a conduit (preferably copper tubing) to form a closed loop system perform the primary functions, which form the vapor compression cycle.

The airflow rate across the evaporator of air conditioners may be affected by different factors. For example, problems such as undersized ducts, dirty filters, or a dirty evaporator coil cause low airflow. Low evaporator airflow reduces the capacity and efficiency of the air conditioner and may, in extreme cases, risk freezing the evaporator coil, which could lead to compressor failure due to liquid refrigerant floodback. On the other hand, if the airflow is too high, the evaporator coil will not be able to do an adequate job of dehumidification, resulting in lack of comfort.

Airflow rate can be determined from capacity measurements. Capacity measurements of an HVAC system can be relatively complex; they require the knowledge of the mass flow rate and enthalpies in either side of the heat exchanger's streams (refrigerant or secondary fluid—air or brine—side). To date, mass flow rate measurements in either side are either expensive or inaccurate. Moreover, capacity measurements and calculations are usually beyond what can be reasonably expected by a busy HVAC service technician on a regular basis.

The method of the invention disclosed herewith provides means for determination of both the mass airflow rate and the volume airflow rates through the evaporator in cooling equipment. Suction temperature, suction pressure, liquid temperature, and liquid (or, alternately, discharge) pressure, all measurements taken on the refrigerant circuit in a vapor compression cycle and the psychrometric conditions (temperature and humidity) of the air entering and leaving the cooling coil are the only data required for such determination. Most of these measurements are needed for standard cycle diagnostics and troubleshooting.

SUMMARY OF THE INVENTION

The present invention includes a method for determining evaporator airflow in cooling equipment by measuring four refrigerant parameters and the psychrometric conditions (temperature and humidity) entering and leaving the evaporator coils.

The present invention is intended for use with any manufacturer's HVAC&R equipment. The present invention, when implemented in hardware/firmware, is relatively inexpensive and does not strongly depend on the skill or abilities of a particular service technician. Therefore, uniformity of service can be achieved by utilizing the present invention, but more importantly the quality of the service provided by the technician can be improved.

The method of the invention disclosed herewith provides means for determination of both the mass and the volumetric airflow rate over the evaporator coils. The psychrometric conditions of the air entering and leaving the evaporator coil are needed, in addition to temperature and pressure measurements on the refrigerant side of the cycle. These pressure measurements are usually made by service technicians with a set of gauges, while the temperatures are commonly measured with a multi-channel digital thermometer.

The present process includes the step of measuring liquid line pressure (or discharge line), suction line pressure, suction line temperature, and liquid line temperature. After these four measurements are taken, the suction dew point and discharge dew point temperatures (evaporating and condensing temperatures for refrigerants without a glide) from the suction line and liquid line pressures as well as the refrigerant enthalpies entering and leaving the evaporator must be obtained. Next, the suction line superheat, the mass flow rate that corresponds to the compressor in the vapor compression cycle for the dew point temperatures and suction line superheat must be obtained. The capacity of the vapor compression cycle from the refrigerant mass flow rate and the enthalpies across the evaporator can now be calculated. The psychrometric conditions of the air entering and leaving the evaporator are measured. The airflow rate in the evaporator can be calculated.

BRIEF DESCRIPTION OF THE DRAWINGS

The accompanying drawings, which are incorporated in, and form a part of, the specification, illustrate the embodiments of the present invention and, together with the description, serve to explain the principles of the invention. For the purpose of illustrating the present invention, the drawings show embodiments that are presently preferred; however, the present invention is not limited to the precise arrangements and instrumentalities shown in the specification.

In the drawings.

DETAILED DESCRIPTION OF PREFERRED EMBODIMENTS

In describing preferred embodiments of the invention, specific terminology has been selected for clarity. However, the invention is not intended to be limited to the specific terms so selected, and it is to be understood that each specific term includes all technical equivalents that operate in a similar manner to accomplish a similar purpose.

The vapor compression cycle is the principle upon which conventional air conditioning systems, heat pumps, and refrigeration systems are able to cool (or heat, for heat pumps) and dehumidify air in a defined volume (e.g., a living space, an interior of a vehicle, a freezer, etc.).

The vapor-compression cycle is made possible because the refrigerant is a fluid that exhibits specific properties when it is placed under varying pressures and temperatures.

Figure 1:
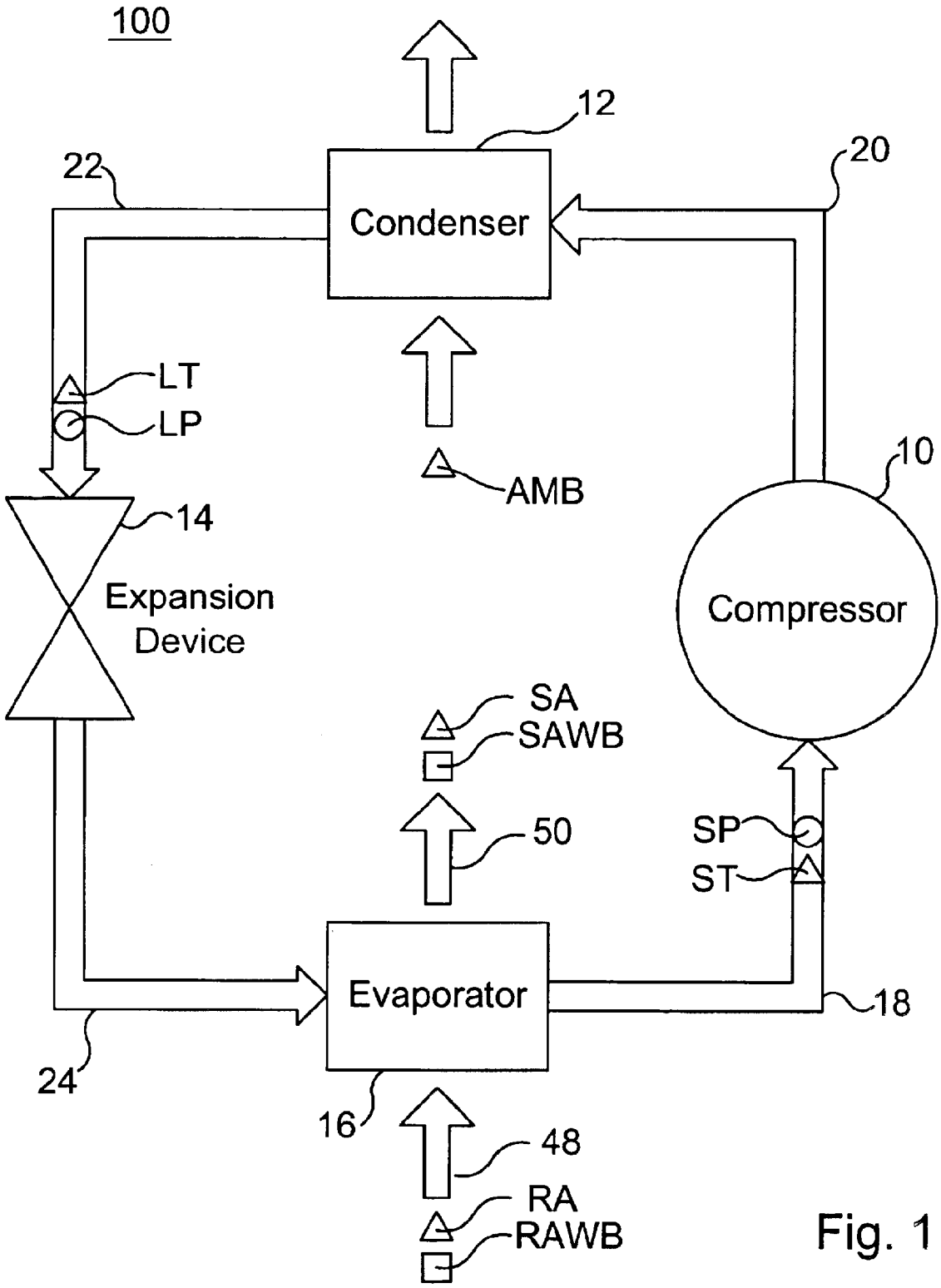
FIG. 1 is a block diagram of a conventional vapor compression cycle.

A typical vapor compression cycle system 100 is illustrated in FIG. 1. The system is a closed loop system and includes a compressor 10, a condenser 12, an expansion device 14 and an evaporator 16. The various components are connected via a conduit (usually copper tubing). A refrigerant continuously circulates through the four components via the conduit and will change state, as defined by its properties such as temperature and pressure, while flowing through each of the four components.

The main operations of a vapor compression cycle are compression of the refrigerant by the compressor 10, heat rejection by the refrigerant in the condenser 12, throttling of the refrigerant in the expansion device 14, and heat absorption by the refrigerant in the evaporator 16. Refrigerant in the majority of heat exchangers is a two-phase vapor-liquid mixture at the required condensing and evaporating temperatures and pressures. Some common types of refrigerant include R-22, R-134A, and R-410A.

In the vapor compression cycle, the refrigerant nominally enters the compressor 10 as a slightly superheated vapor (its temperature is greater than the saturated temperature at the local pressure) and is compressed to a higher pressure. The compressor 10 includes a motor (usually an electric motor) and provides the energy to create a pressure difference between the suction line and the discharge line and to force the refrigerant to flow from the lower to the higher pressure. The pressure and temperature of the refrigerant increases during the compression step. The pressure of the refrigerant as it enters the compressor is referred to as the suction pressure and the pressure of the refrigerant as it leaves the compressor is referred to as the head or discharge pressure. The refrigerant leaves the compressor as highly superheated vapor and enters the condenser 12. Continuing to refer to FIG. 1, a "typical" air-cooled condenser 12 comprises single or parallel conduits formed into a serpentine-like shape so that a plurality of rows of conduit is formed parallel to each other. Although the present document makes reference to air-cooled condensers, the invention also applies to other types of condensers (for example, water-cooled).

Metal fins or other aids are usually attached to the outer surface of the serpentine-shaped conduit in order to increase the transfer of heat between the refrigerant passing through the condenser and the ambient air. A fan mounted proximate the condenser for blowing outdoor ambient air through the rows of conduit also increase the transfer of heat.

As refrigerant enters a "typical" condenser, the superheated vapor first becomes saturated vapor in the first section of the condenser, and the saturated vapor undergoes a phase change in the remainder of the condenser at approximately constant pressure. Heat is rejected from the refrigerant as it passes through the condenser and the refrigerant nominally exits the condenser as slightly subcooled liquid (its temperature is lower than the saturated temperature at the local pressure).

The expansion (or metering) device 14 reduces the pressure of the liquid refrigerant thereby turning it into a saturated liquid-vapor mixture at a lower temperature, before the refrigerant enters the evaporator 16. This expansion is also referred as the throttling process. The expansion device is typically a capillary tube or fixed orifice in small capacity or low-cost air conditioning systems, and a thermal expansion valve (TXV or TEV) or electronic expansion valve (EXV) in larger units. The TXV has a temperature-sensing bulb on the suction line. It uses that temperature information along with the pressure of the refrigerant in the evaporator to modulate (open and close) the valve to try to maintain proper compressor inlet conditions. The temperature of the refrigerant drops below the temperature of the indoor ambient air as the refrigerant passes through the expansion device. The refrigerant enters the evaporator 16 as a low quality saturated mixture. ("Quality" is defined as the mass fraction of vapor in the liquid-vapor mixture.)

A direct expansion evaporator 16 physically resembles the serpentine-shaped conduit of the condenser 12. Ideally, the refrigerant completely boils by absorbing energy from the defined volume to be cooled (e.g., the interior of a refrigerator). In order to absorb heat from this volume of air, the temperature of the refrigerant must be lower than that of the volume to be cooled. Nominally, the refrigerant leaves the evaporator as slightly superheated gas at the suction pressure of the compressor and reenters the compressor thereby completing the vapor compression cycle. (It should be noted that the condenser 12 and the evaporator 16 are types of heat exchangers and are sometimes referred to as such in the text.)

Although not shown in FIG. 1, a fan driven by an electric motor is usually positioned next to the evaporator 16; a separate fan/motor combination is also usually positioned next to the condenser 12. The fan/motor combinations increase the airflow over their respective evaporator or condenser coils, thereby enhancing the heat transfer. For the, the beat transfer is from the indoor ambient volume to the refrigerant flowing through the evaporator, for the condenser, the heat transfer is from the refrigerant flowing through the condenser to the outside air.

The airflow about to enter the evaporator 16 is generally indicated by arrow 48 and the airflow exiting the evaporator is generally indicated by arrow 50.

Finally, although not shown in FIG. 1, there is a control system that allows users to operate and adjust the desired temperature within the indoor ambient volume. The most basic control system for an air conditioning system comprises a low voltage thermostat that is mounted on a wall inside the ambient volume, and relays that are connected to the thermostat which control the electric current delivered to the compressor and fan motors. When the temperature in the ambient volume rises above a predetermined value on the thermostat, a switch closes in the thermostat, forcing the relays to close, thereby making contact, and allowing current to flow through the compressor and the motors of the fan/motors combinations. When the vapor compression cycle has cooled the air in the indoor ambient volume below the predetermined value set on the thermostat, the switch opens thereby causing the relays to open and turning off the current through the compressor and the motors of the fan/motor combination.

Referring again to FIG. 1, the important states of a vapor compression cycle may be described as follows:

State 1: Refrigerant leaving the evaporator and entering the compressor. (The tubing connecting the evaporator to the compressor is called the suction line 18.)

State 2: Refrigerant leaving the compressor and entering the condenser (The tubing connecting the compressor to the condenser is called the discharge or hot gas line 20).

State 3: Refrigerant leaving the condenser and entering the expansion device. (The tubing connecting the condenser and the expansion device is called the liquid line 22).

State 4: Refrigerant leaving the expansion device and entering the evaporator (connected by tubing 24).

The numbers (1 through 4) are used as subscripts in this document to indicate that a property is evaluated at one of the states above.

Figure 2:
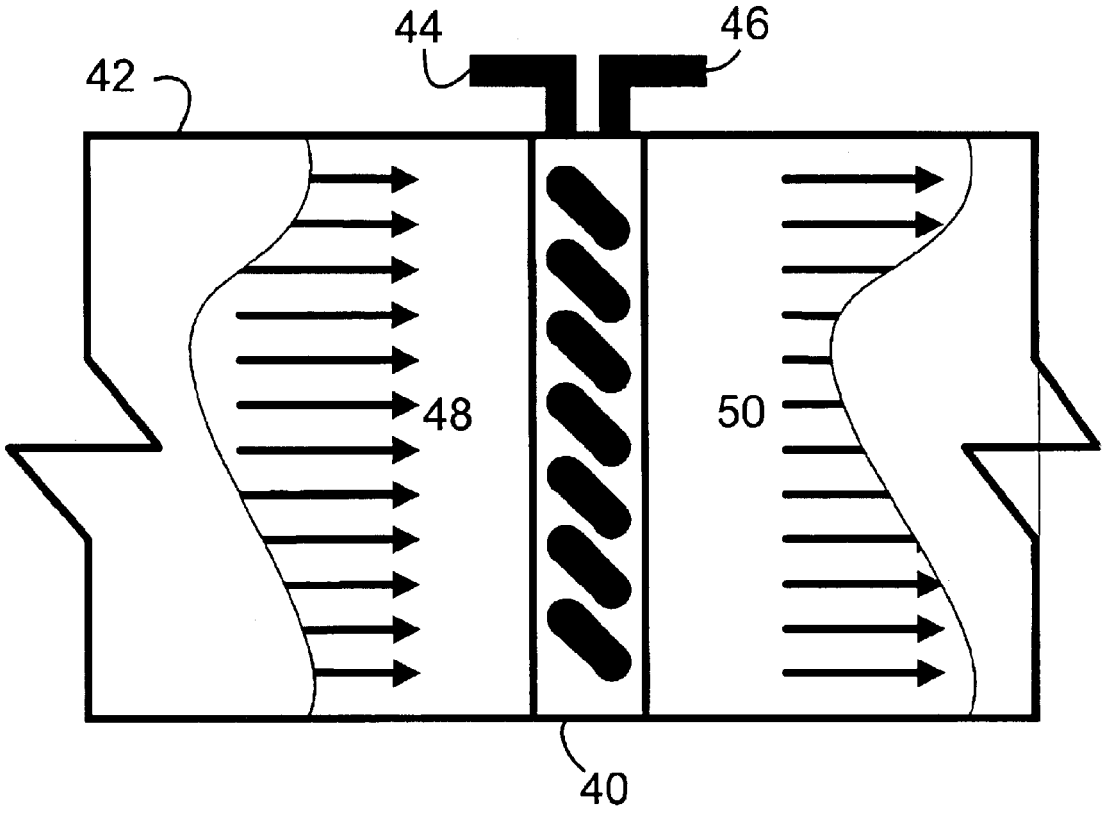
FIG. 2 is a schematic diagram of an evaporator 40 in an air duct.

Referring now to FIG. 2, there is an evaporator coil 40 installed in a duct 42. Refrigerant inlet 44 and refrigerant outlet 46 are provided for supplying cold refrigerant to the evaporator. At the air inlet (return air), means for measuring the psychrometric conditions of the air 48 about to enter the evaporator are provided. At the air outlet (supply air), means for measuring the psychrometric conditions of the air 50 leaving the evaporator are also provided.

In the present invention, the four measurements on the refrigerant side are;

ST—refrigerant temperature in the suction line or suction temperature (state 1), SP—refrigerant pressure in the suction line or suction pressure (state 1), LT—refrigerant temperature in the liquid line or liquid temperature (state 3), and LP—refrigerant pressure in the liquid line or liquid pressure (state 3).

Alternately, the discharge pressure may be measured instead of the liquid pressure (state 2). In the air side, the following are needed:

RA—return air dry-bulb temperature,

RAWB—return air wet-bulb temperature,

SA—supply air dry-bulb temperature, and

SAWB—supply air wet-bulb temperature.

The locations of the sensors are shown in the schematic diagram of FIG. 1. Note that AMB is the outdoor ambient air temperature before going through the condenser 12.

Although a primary embodiment requires dry-bulb and wet-bulb temperatures, alternative ways to determine the return and supply air stream psychrometric conditions, such as relative humidity or enthalpy, may also be used.

Various gauges and, sensors are known in the art that are capable of making the measurements. Service technicians universally carry such gauges and sensors with them when servicing a system. Also, those in the art will understand that some of the measurements can be substituted. For example, the saturation temperature in the evaporator and the saturation temperature in the condenser can be measured directly with temperature sensors to replace thesuction pressure and liquid pressure measurements, respectively. In a preferred embodiment, the above-mentioned measurements are taken The method consists of the following steps:

A. Measure the liquid and suction pressures (LP and SP, respectively); measure the liquid and suction line temperatures (LT and ST, respectively). Also determine the air enthalpy entering and leaving the evaporator coil by measuring the return air dry-bulb temperature (RA) and return air wet-bulb temperature (RAWB), the supply air dry-bulb temperature (SA) and the supply air wet-bulb temperature (SAWB). These measurements are all common field measurements that any HVACR technician makes using currently available equipment (e.g., gauges, transducers, thermistors, thermometers, sling psychrometer, etc.). Use the discharge line access port to measure the discharge pressure DP when the liquid line access port is not available. Even though the pressure drop across the condenser 12 results in an overestimate of subcooling, assume LP is equal to DP. Or use data provided by the manufacturer to estimate the pressure drop and determine the actual value of LP.

B. Compressor manufacturers make available compressor performance data (compressor maps) in a polynomial format based on Standard 540-1999 created by the Air-Conditioning and Refrigeration Institute (ARI) for each compressor they manufacture. ARI develops and publishes technical standards for industry products, including compressors. The data provided by the standard includes power consumption, mass flow rate, current draw, and compressor efficiency.

Establish that the compressor 10 is operating properly. Use the standard ARIM equation to obtain the compressor's design refrigerant mass flow rate ($\dot{m}_{map}$) as a function of its suction dew point temperature (SDT) and discharge dew point temperature (DDT). The dew point temperature is determined directly from the suction refrigerant pressure (SP) and the liquid pressure (LP), from the saturation pressure-temperature relationship. Assume that the pressure drop in the liquid line and condenser is small such that LP is practically the compressor discharge pressure, if the discharge pressure (DP) is not being measured.

It will be clear to those skilled in the art, after reading this disclosure, that other equation forms or a look-up table of the compressor performance data may be used instead of the ARI format.

Identify the compressor used in the equipment under analysis to determine the set of coefficients to be used. When the coefficients are not available for the specific compressor used, it is usually acceptable to select a set of coefficients for a similar compressor. It is suggested that the similar compressor be of the same technology as the compressor in the HVAC system being tested and of similar capacity.

ARI equations are available for different compressors, both from ARI and from the compressor manufacturers. The equations are polynomials of the following form $$\dot{m}_{map} = a_0 + \sum_{i=1}^{3} a_i SDT^i + \sum_{i=4}^{6} a_i DDT^{i-3} + a_7 SDT\ DDT + a_8 SDT\ DDT^2 + a_9 SDT^2 DDT \quad (1)$$

where the coefficients $a_i$ (i=0 to 9) are provided for the compressor and are provided by the manufacturer according to ARI Standard 540-1999. The suction dew point and discharge dew point temperatures in equation (1) can be in either ° F. or ° C., using the corresponding set of coefficients. The mass flow rate calculated is in kg/s.

For refrigerants that do not present a glide, the suction dew point and the suction bubble point temperatures are exactly the same. In the present document it will be called evaporating temperature (ET). The same is true for the discharge dew point and the discharge bubble point temperatures, in which case it will be called condensing temperature (CT).

Compressor performance equations, such as equation (1), are usually defined for a specific suction line superheat ($SH_{map}$), typically 20° F. ARI Standard 540-1999 tabulates the suction line superheat and it is equal to 20° F. (for air-conditioning applications). Under actual operating conditions, however, the suction line superheat may be different than the specified value, depending on the working conditions of the refrigeration cycle. ARI Standard 540-1999 requires that superheat correction values be available when the superheat is other than that specified.

If the ARI standard superheat corrections are not available, the mass flow rate is corrected using the actual suction line temperature (ST). First, evaluate the suction line design temperature, $ST_{map}$ as $$ST_{map}=ET+SH_{map} \tag{2}$$

Assuming that the compressibility of the gas remains constant, the refrigerant density is inversely proportional to the temperature at the suction pressure. Thus, one may write $$\dot{m} = \frac{ST_{map}}{ST}\dot{m}_{map}, \tag{3}$$

where the temperatures must be in an absolute scale (either Kelvin or Rankine).

C. Use the liquid line temperature (LT) and high side pressure (LP) to determine the liquid line subcooling (SC) as $$SC=CT-LT \tag{4}$$

If SC is greater than 0, then estimate the liquid line refrigerant specific enthalpy ($h_3$) using the well-known properties of single-phase subcooled refrigerant $$h_3=h(LT, LP). \tag{5}$$

If the refrigerant leaves the condenser as a two-phase mixture, there is no liquid line subcooling, and pressure and temperature are not independent properties, so they cannot define the enthalpy. Some other property must be known, such as the quality, $x_3$, to determine the enthalpy at state 3. Since this is difficult, a method for estimating $h_3$ that is easy to evaluate is derived. An energy balance over the area of the condenser coil where a two-phase flow exists leads to $$\dot{m}(h_g-h_3)=\overline{U}A\ CTA, \tag{6}$$

where $h_g$ is the saturated vapor enthalpy at the liquid pressure, $\overline{U}$ is the average (over the length) overall heat transfer coefficient, A is the heat exchanger area where two-phase flow exists, and CTA is the difference between the condensing temperature and the outdoor ambient air temperature (AMB) that must be measured. (See FIG. 1.) Defining $h_f$ as the saturated liquid enthalpy at the liquid pressure, equation (6) applies when $h_f<h_3<h_g$ (i.e., when a mixture exits the condenser), which may happen when the unit is severely undercharged.

For a unit operating in nominal conditions, the refrigerant is a saturated liquid at the end of the two-phase region of the condenser and the same energy balance reads $$\dot{m}_n h_{fg,n}=\bar{U}_n A_n CTA_n, \tag{7}$$

where $h_{fg,n}$ is the latent heat of vaporization at the liquid pressure. From equations (6) and (7), one may write $$h_3 = h_g - \frac{\dot{m}_n}{\dot{m}}\frac{\overline{U}}{\overline{U}_n}\frac{A}{A_n}\frac{CTA}{CTA_n}h_{fg,n}, \tag{8}$$

If all the variables in equation (8) are known, the enthalpy of the mixture at state 3 can be calculated.

The mass flow rate, the average overall heat transfer coefficient and the area of the heat exchanger where a two-phase mixture exists all vary with the operating conditions of the cycle. Unfortunately, the average overall heat transfer coefficient and the area of the heat exchanger where two-phase flow exists are difficult to obtain. As an approximation, consider that the product $\overline{U}A/\dot{m}$ does not vary significantly. In that case, the enthalpy of the mixture at the exit of the condenser is $$h_3 \cong h_g - \frac{CTA}{CTA_n}h_{fg,n}, \tag{9}$$

Equation (9) is an approximate solution to determine $h_3$ when the refrigerant leaves the condenser as a two-phase mixture (i.e., liquid-vapor mixture).

The value of $CTA_n$ depends on the nominal EER of the equipment. A suggested value, based on a 10-EER unit, is 20° F.

D. Use the suction line temperature (ST) and pressure (SP) to determine the suction line 18 superheat (SH)

$$SH=ST-ET \tag{10}$$

If SH is greater than 0, then estimate the suction line refrigerant specific enthalpy ($h_1$) using the well-known properties of single-phase superheated refrigerant $$h_1=h(ST,SP) \tag{11}$$

If there is no suction line superheat, pressure and temperature are not independent properties, so they cannot define the enthalpy. Some other property must be known, such as the quality, to determine the enthalpy at state 1. However, it is important to note that the system should not operate with liquid entering the compressor, because this may cause a premature failure leading to a compressor replacement.

E. Assume there is no enthalpy drop across the expansion device, i.e., $$h_4 h_3 \tag{12}$$

Estimate capacity($\dot{Q}$) using the estimates of mass flow rate ($\dot{m}$), the liquid line specific enthalpy ($h_4$), and the suction line specific enthalpy ($h_1$) as $$\dot{Q}=\dot{m}(h_1-h_4) \tag{13}$$

F. Determine the enthalpies of the return and supply air from the dry-bulb and wet-bulb temperatures. There are different ways that the enthalpies of the humid air can be determined. For example, a psychrometric chart can be used. In the preferred embodiment, the following equations (14–17) are used (ASHRAE Handbook, Fundamentals, Chapter 6), where T is the dry-bulb temperature (either RA or SA) and $T_{wb}$ is the wet-bulb temperature (either RAWB or SAWB).

The saturation pressure over water for the temperature range of 0 to 200° C. is given by $$p_{ws}(T_{wb}) = \exp\left(\frac{C_8}{T_{wb}} + C_9 + C_{10}T_{wb} + C_{11}T_{wb}^2 + C_{12}T_{wb}^3 + C_{13}\ln T_{wb}\right), \quad (14)$$

where the values of the coefficients $C_8$ through $C_{13}$ are −5.8002206E+03, 1.3914993E+00, −4.8640239E-02, 4.1764768E-05, −1.4452093E-08, and 6.5459673E+00, respectively. The temperatures in equation (14) are in K, while the calculated pressure is in pascal (Pa).

The humidity ratio corresponding to saturation at the wet-bulb temperature can be calculated as $$W_s(T_{wb}) = 0.62198\frac{p_{ws}(T_{wb})}{p - p_{ws}(T_{wb})}, \quad (15)$$

where p is the stream pressure.

The humidity ratio of the humid air is $$W = \frac{(2501 - 2.381T_{wb})W_s(T_{wb}) - (T - T_{wb})}{2501 + 1.805T - 4.186T_{wb}}, \quad (16)$$

where the temperatures are in ° C. The humidity ratio calculated is in kg of water per kg of dry air.

The enthalpy of the air stream can be calculated as $$h = 1.006T + W(2501 + 1.805T), \quad (17)$$

where h is in kJ/kg.

Please note that equations (14) through (17) have to be employed twice: once for return air, and again for supply air, obtaining $h_{RA}$ and $h_{SA}$, respectively.

From an energy balance across the evaporator coil, the mass flow rate of air can be calculated as $$\dot{m}_a = \dot{m}\frac{h_1 - h_4}{h_{RA} - h_{SA}}. \quad (18)$$

The specific volume of moist air is calculated as $$v = 0.2871(1 + 1.6078W)T/p, \quad (19)$$

where W, T, and p are the humidity ratio (kg of water per kg of dry air), dry-bulb temperature (K), and pressure (kPa) at either the return or supply air stream, depending if the airflow is being calculated before or after the evaporator coil. The specific volume is in $m^3$/kg.

The volumetric flow rate of air is calculated as $$\dot{V} = v\dot{m}, \quad (20)$$

where the volumetric flow rate is in $m^3$/s.

The volumetric flow rate per nominal cooling capacity can be calculated as $$\varphi = \frac{\dot{V}}{NCAP}.$$

This parameter is particularly useful as technicians are trained to expect an airflow rate of about 400 $ft^3$/min/ton, when $\phi$ is calculated using the volumetric flow rate $\dot{V}$ in CFM ($ft^3$/min) and the nominal capacity NCAP in tons. ("Ton" refers to the cooling capacity of the refrigeration unit where one ton equals 12,000 Btu per hour.)

Since it takes into account the change in capacity as the driving conditions change and how well the unit is maintained, the present invention is preferable to the traditional method of using the temperature split across the evaporator to evaluate airflow.

The present invention was described in connection with a refrigerator or air conditioning system. It will be apparent to one skilled in the art, after reading the present specification, that the above methods may be adapted for use in connection with a heat pump.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

We claim:

1. In vapor compression equipment having a compressor, a condenser, an expansion device and an evaporator arranged in succession and connected via a conduit in a closed loop for circulating refrigerant through the closed loop, a process for determining the airflow rate through the evaporator, the process comprising the steps of:

obtaining the suction dew point and discharge dew point temperatures from the suction line and liquid line pressures;

obtaining the refrigerant mass flow rate that corresponds to the compressor in the vapor compression cycle for the dew point temperatures and suction line superheat;

obtaining the enthalpies at the suction line and at the inlet of the evaporator;

obtaining the enthalpies of the air entering and leaving the evaporator; and calculating the airflow mass flow rate across the evaporator.

2. The process of claim 1 wherein said step of obtaining the mass flow rate comprises the step of calculating compressor performance data from ARI (Air-Conditioning and Refrigeration Institute) Standard 540-1999 performance equations available for the specific compressor.

3. The process of claim 2, further comprising the steps of:

calculating the suction line superheat;

obtaining the suction line superheat specified by the compressor manufacturer;

comparing the calculated suction line superheat to the suction line superheat specified by the compressor manufacturer; and, if the calculated suction line superheat is different than the suction line superheat specified by the compressor manufacturer, correcting the mass flow rate by multiplying the suction line superheat specified by the compressor manufacturer by the ratio of the design suction line absolute temperature over the actual suction to line absolute temperature.

4. The process of claim 1 wherein said step of obtaining the mass flow rate comprises the step of determining the compressor map equation by reading relevant information from the compressor manufacturer's look-up table for the specific compressor.

5. The process of claim 4, further comprising the steps of:

calculating the suction line superheat;

obtaining the suction line superheat specified by the compressor manufacturer;

comparing the calculated suction line superheat to the suction line superheat specified by the compressor manufacturer; and, if the calculated suction line superheat is different than the suction line superheat specified by the compressor manufacturer, correcting the mass flow rate by multiplying the suction line superheat specified by the compressor manufacturer by the ratio of the design suction line absolute temperature over the actual suction line absolute temperature.

6. The process of claim 1, where the mass flow rate is determined from information obtained from a compressor similar to but not exactly the same as said compressor being in the vapor compression cycle.

7. The process of claim 6 wherein said step of obtaining the mass flow rate comprises the step of determining the compressor map equation by reading relevant information from the compressor manufacturer's look-up table for a compressor similar to the specific compressor used in the vapor compression cycle.

8. The process of claim 7, further comprising the steps of:

calculating the suction line superheat;

obtaining the suction line superheat specified by the compressor manufacturer;

comparing the calculated suction line superheat to the suction line superheat specified by the compressor manufacturer; and, if the calculated suction line superheat is different than the suction line superheat specified by the compressor manufacturer, correcting the mass flow rate by multiplying the suction line superheat specified by the compressor manufacturer by the ratio of the design suction line absolute temperature over the actual suction line absolute temperature.

9. The process of claim 1, where the refrigerant leaves the condenser as a liquid-vapor mixture, and its enthalpy is calculated through the following steps:

measuring the temperature of the air entering the condenser;

obtaining the enthalpy of the saturated vapor at the liquid pressure;

obtaining the latent heat of vaporization at the liquid pressure;

calculating the difference between the condensing temperature and the temperature of the air entering the condenser;

obtaining the nominal difference between the condensing temperature and the temperature of the air entering the condenser; and calculating the enthalpy of the refrigerant as the enthalpy of the saturated vapor at the liquid pressure minus the ratio of the difference between the condensing temperature and the temperature of the air entering the condenser to the nominal difference between the condensing temperature and the temperature of the air entering the condenser, and multiplying the ratio by the latent heat of vaporization at the liquid pressure.

10. In vapor compression equipment having a compressor, a condenser, an expansion device and an evaporator arranged in succession and connected via a conduit in a closed loop for circulating refrigerant through the closed loop, a process for determining the airflow through the evaporator, the process comprising the steps of:

measuring liquid line pressure, suction line pressure, suction line temperature, and liquid line temperature;

obtaining the suction dew point and discharge dew point temperatures from the suction line and liquid line pressures;

obtaining the suction line superheat;

obtaining the mass flow rate that corresponds to the compressor in the vapor compression cycle for the dew point temperatures and suction line superheat;

obtaining the suction line superheat specified by the compressor manufacturer;

comparing the calculated suction line superheat to the suction line superheat specified by the compressor manufacturer; and, if the calculated suction line superheat is different than the suction line superheat specified by the compressor manufacturer, correcting the mass flow rate by multiplying the suction line superheat specified by the compressor manufacturer by the ratio of the design suction line absolute temperature over the actual suction line absolute temperature;

obtaining the enthalpies at the suction line and at the inlet of the evaporator;

calculating the capacity of the vapor compression cycle from the mass flow rate and the enthalpies across the evaporator;

obtaining the enthalpies of the air entering and leaving the evaporator; and calculating the airflow mass flow rate across the evaporator.

11. The process of claim 10 wherein said step of obtaining the mass flow rate comprises the step of calculating compressor performance data from ARI (Air-Conditioning and Refrigeration Institute) Standard 540-1999 performance equations available for the specific compressor.

12. The process of claim 10 wherein said step of obtaining the mass flow rate comprises the step of determining the compressor map equation by reading relevant information from the compressor manufacturer's look-up table for the specific compressor.

13. The process of claim 10 wherein said step of obtaining the mass flow rate comprises the step of determining the compressor map equation by reading relevant information from the compressor manufacturer's look-up table for a compressor similar to the specific compressor used in the vapor compression cycle.

14. The process of claim 10, where the refrigerant leaves the condenser as a liquid-vapor mixture, and its enthalpy is calculated through the following steps:

measuring the temperature of the air entering the condenser;

obtaining the enthalpy of the saturated vapor at the liquid pressure;

obtaining the latent heat of vaporization at the liquid pressure;

calculating the difference between the condensing temperature and the temperature of the air entering the condenser;

obtaining the nominal difference between the condensing temperature and the temperature of the air entering the condenser;

calculating the enthalpy of the refrigerant as the enthalpy of the saturated vapor at the liquid pressure minus the ratio of the difference between the condensing temperature and the temperature of the air entering the condenser to the nominal difference between the condensing temperature and the temperature of the air entering the condenser, then multiplying the ratio by the latent heat of vaporization at the liquid pressure.

* * * * *

UNITED STATES PATENT AND TRADEMARK OFFICE

CERTIFICATE OF CORRECTION

PATENT NO. : 6,973,793 B2
DATED : December 13, 2005
INVENTOR(S) : Douglas et al.

It is certified that error appears in the above-identified patent and that said Letters Patent is hereby corrected as shown below:

Column 3,
Line 12, reference numeral 14 should be bolded.

Column 4,
Line 34, delete "beat" and substitute -- heat --.
Line 35, delete "," after "evaporator" and substitute -- ; --.

Column 5,
Line 42, delete "," after "and.".

Column 6,
Line 15, delete "ARIM" and substitute -- ARI --.

Column 7,
Line 57, delete "$h_j<h_3<h_g$" and substitute -- $h_f<h_3<h_g$ --.

Column 8,
Line 50, delete "$h_4h_3$" and substitute -- $h_4 = h_3$ --.

Column 9,
Line 62, add -- (21) -- at the end of the line to signify the 21st equation.

Signed and Sealed this

Twenty-first Day of March, 2006

JON W. DUDAS
*Director of the United States Patent and Trademark Office*